United States Patent [19]

McLoughlin

[11] Patent Number: 4,526,347

[45] Date of Patent: Jul. 2, 1985

[54] FENCE ASSEMBLY

[75] Inventor: Thomas P. McLoughlin, Dublin, Ireland

[73] Assignee: Institute for Industrial Research and Standards, Dublin, Ireland

[21] Appl. No.: 386,137

[22] Filed: Jun. 7, 1982

[30] Foreign Application Priority Data

| | | | |
|---|---|---|---|
| Jun. 9, 1981 | [IE] | Ireland | 1273/81 |
| Aug. 5, 1981 | [IE] | Ireland | 1782/81 |
| Jan. 13, 1982 | [IE] | Ireland | 51/82 |
| Feb. 9, 1982 | [IE] | Ireland | 279/82 |
| Apr. 20, 1982 | [IE] | Ireland | 934/82 |

[51] Int. Cl.[3] ..... B21F 27/00; E04H 17/02

[52] U.S. Cl. ..... 256/33; 256/45; 47/44; 245/5

[58] Field of Search ..... 245/5, 7, 8; 52/581, 52/662, 670, 671, 674, 675, 676; 256/45, 33; 47/44

[56] References Cited

U.S. PATENT DOCUMENTS

| | | | |
|---|---|---|---|
| 573,370 | 12/1896 | Swinscoe | 245/5 |
| 932,355 | 8/1909 | Thrasher et al. | 256/26 |
| 2,732,707 | 1/1956 | Ries | 52/671 X |
| 3,423,072 | 1/1969 | Bernstein | 256/24 |
| 3,651,851 | 3/1972 | Curtis | 256/33 X |
| 3,840,947 | 10/1974 | Burbidge | 256/33 X |
| 4,081,148 | 3/1978 | Murphy | 256/45 X |
| 4,290,602 | 9/1981 | Kennedy | 256/23 X |

*Primary Examiner*—Andrew V. Kundrat

*Attorney, Agent, or Firm*—Ladas & Parry

[57] ABSTRACT

A fence assembly comprises a plurality of panels of expanded metal mesh having a plurality of closed meshes. The panels are arranged in zig-zag relationship, and each panel is joined to another panel by means of portion of some of the meshes of the panel adjacent an edge thereof, projecting through meshes of the other panel. The interlocking meshes are intertwined to retain the panels interlocked. The fence assembly may be secured to, or buried in, a trench in the ground.

14 Claims, 19 Drawing Figures

FENCE ASSEMBLY

BACKGROUND TO THE INVENTION

1. Field of the Invention

The present invention relates to a fence assembly of the type comprising a plurality of panels of semi-rigid net-like material, each panel having a plurality of closed meshes.

2. Description of the Prior Art

Fence assemblies of this type are well known and are used extensively for partitioning storage areas, warehouses, factories and additionally for perimeter fencing around building sites, security compounds, and the like. These fences may be either permanently mounted or demountable.

One example of such a fence assembly is described in U.S. Pat. No. 3,423,072. This Specification discloses a fence assembly comprising a plurality of panels of net-like material. Each panel is provided with sidewardly projecting unclosed hooks on each vertical side of the panel. A vertical stanchion or fence post engages the hooks of adjacent panels to secure the panels together.

Another example of fence assembly is described in U.S. Pat. No. 932,355 which discloses a fence assembly also comprising a plurality of panels of net-like material. In this case, the panels are mounted in a rectangular wire frame and loops are formed on the vertical sides of the wire frame. A stanchion or fence post engages the loops on adjacent panels to secure the panels together.

Another example of fence assembly is described in U.S. Pat. No. 3,651,851. This Specification discloses a foldable fence assembly comprising a plurality of panels of net-like material. In this case, the panels are formed by a plurality of vertical and horizontal bars welded together. The panels are joined by a plurality of rings which engage adjacent vertical bars of adjacent panels. This permits the panels to pivot relative to each other for folding purposes.

It is also known to mount panels of net-like material in angle-iron frames. In these cases the angle-iron frames are bolted together and in turn are bolted to intermediate upright stanchions.

All these known fence assemblies suffer from a major problem in that they lack inherent strength. A stanchion or fence post is required to support the fence assembly. This contributes to the relatively high cost, and also the length of time required to erect such fence assemblies. Furthermore, these known fences may be easily opened at the joints between the panels and/or to the stanchions, thereby providing ready access to intruders.

More specifically in the case of the fence assembly of U.S. Pat. No. 3,423,072 a fence post is required to support the panels and also to retain the panels interlocked at the joints. Further, the joints between the panels may be easily opened by pushing against a panel. If sufficient pressure is applied to any one of the panels, the unclosed hooks engaging the fence post will straighten, thereby permitting the panel to be disengaged from the post. This can be a particular problem when a crowd of people push against a panel. Even if the hooks are sufficiently strong to overcome pressure on the panel, the shanks of the hooks can in general be relatively easily cut. Indeed by merely cutting a few hooks the panel can be pulled away from the bar to form a gap for the would-be intruder.

Again in the fence assembly of U.S. Pat. No. 932,355 fence posts are required to support and join the panels.

Furthermore by cutting the loops on the wire frame, a panel can easily be disengaged from the fence post. In the particular embodiment described in the U.S. Specification the mere cutting of three loops is sufficient to disengage a panel. This particular fence assembly suffers from a further disadvantage in that the net panel is mounted within the wire frame, and accordingly, can be dislodged from the frame by cutting one or two strands of the panel. Indeed it will be appreciated that even if the net panel was spot welded to the frame, the welds could easily be broken.

The foldable fence assembly of U.S. Pat. No. 3,651,851 suffers from the major problem that it lacks inherent strength. This fence assembly is clearly only suitable for enclosing an animal or chicken compound. It would be of little use as a security fence. By merely cutting three of the joining rings, the panels could readily easily be separated. Indeed, even if more rings were used this would not provide an effective bar against a would-be intruder. Additionally, by merely cutting portions of one of the vertical bars, a joint could also be opened between panels.

It is questionable whether the fence assembly as proposed in this Specification would be self supporting. More than likely, stanchions would be required, and in particular stanchions would be required at each end of a run of the fence assembly.

Similar problems occur where the panels of a fence assembly comprise net material mounted in a framework of, for example, angle iron. Once nuts and bolts are used either in joining the panels directly together or to a stanchion it will be readily appreciated that the joint may be easily broken.

All these fence assemblies are also relatively expensive. In the case of the fence assemblies of the three U.S. Specifications, standard off-the-shelf panels cannot be used. Thus additional expense is incurred in the provision of special panels. Indeed, in the case of U.S. Pat. No. 3,423,072 even if standard panels are used, the vertical edges of the panels have to be trimmed in such a way as to leave a sufficient amount of material to form the hooks, and subsequently, the hooks have to be formed.

OBJECTS OF THE INVENTION

One object of the invention is to provide a secure fence assembly of panels of net-like material, which is inherently strong, and can withstand crowds pushing against it, or vehicles being driven into it.

Another object of the invention is to provide a fence assembly in which the panel joints are secure and can withstand attempts to open them by vandals and intruders.

A further object of the invention is to provide a relatively inexpensive fence assembly, which is both relatively inexpensive to install and also in which the component parts can be provided relatively inexpensively.

A still further object of the invention is to provide a fence assembly in which stanchions or fence posts are not required.

SUMMARY OF THE INVENTION

According to the invention there is provided a fence assembly comprising a plurality of interlocking panels of semi-rigid net-like material arranged in zig-zag relationship, each panel having a plurality of closed meshes, and being joined to another panel by portion of at least some of the meshes of the panel adjacent an edge thereof projecting through meshes of the other panel, at least some of the meshes being bent to interlock with the meshes of the other panel.

In one embodiment of the invention the projecting meshes are bent through an angle of at least 90°, and preferably, the interlocking meshes are intertwined with each other.

Preferably, the panels are bent intermediate their side edges to form an included angle of approximately 90°.

Advantageously, anchor means are provided by a base member projecting sidewardly from some or all of the panels.

In another embodiment of the invention, a cat-walk is provided by a capping member of semi-rigid net-like material mounted on top of the fence panels.

In another embodiment of the invention, upright support members are provided in at least some of the included angles formed by the panels of the fence assembly, water jets outwardly directed of the fence assembly being mounted on the upright support members.

In a further embodiment of the invention a solid strengthening portion extends the length of each panel intermediate its side edges, the panels being bent along the solid strengthening portion to form a member of angle section in each panel.

Preferably, the semi-rigid net-like material is of expanded metal mesh. Advantageously, the solid strengthening portion is formed by leaving portion of each panel unexpanded.

ADVANTAGES OF THE INVENTION

One advantage of the invention is that it provides a particularly strong robust fence assembly, and because the panels are arranged in zig-zag relationship, and the panels are joined by means of their meshes interlocking, the fence assembly is inherently strong and no stanchions are required. This leads to a relatively inexpensive and easy to erect fence assembly. Furthermore, because the panels are joined by means of their meshes being interlocked, this provides additional strength to the assembly, and also makes it virtually impossible to open the joints. This is particularly so when the meshes are intertwined. Furthermore, because of the construction of the fence assembly, standard off-the-shelf panels may be used, this considerably reduces the cost of manufacturing the panels of the fence assembly and leads to a relatively easily manufactured and assembled fence assembly.

Additionally, when the fence assembly is buried in the ground, and in particular, when it is provided with anchor means, it is virtually impossible for the fence assembly to be pushed over by either a crowd pressing against it or a vehicle being driven against it. Additionally, the provision of upright support members further enhances this quality of the fence assembly. Indeed, when the upright support members are provided with water jets, they are ideally suited for crowd control in the event of a riot. Additionally, the provision of a cat-walk around the top of the fence assembly has the advantage that firstly, it considerably increases the rigidity and inherent strength of the fence, and also provides a useful lookout for a person patrolling around the perimeter of a compound which the fence assembly encompasses.

These and other objects and advantages of the invention will be readily apparent from the following description of some preferred embodiments thereof, which are given by way of example only with reference to the accompanying drawings.

DETAILED DESCRIPTION OF THE INVENTION

Figure 1:
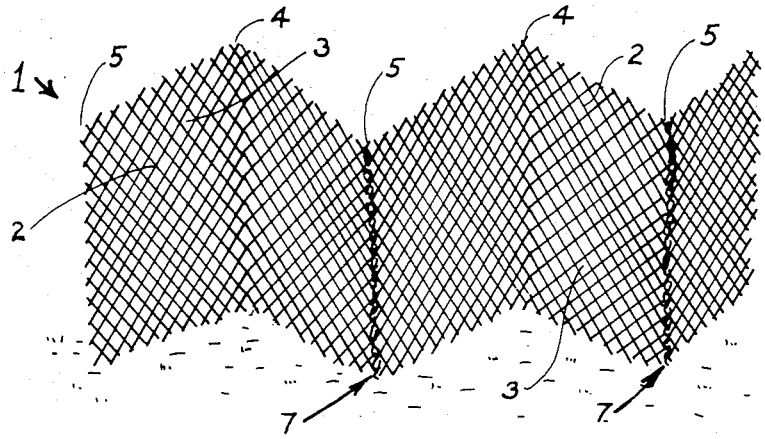
FIG. 1 is a perspective view of a fence assembly according to the invention in position.
Figure 3:
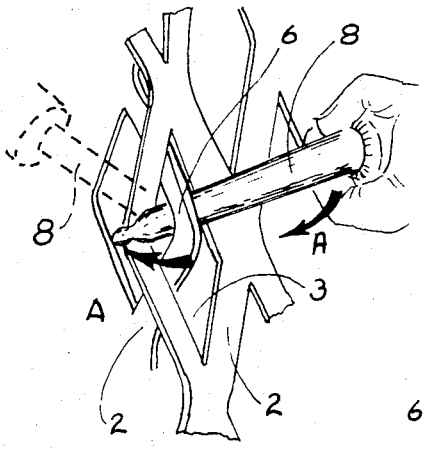
FIG. 3 is a perspective view of a further detail of FIG. 1.
Figure 2:
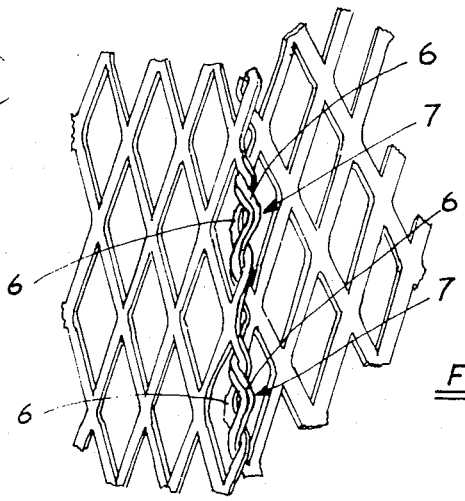
FIG. 2 is a perspective view of a detail of the fence assembly of FIG. 1.

Referring to the drawings and initially to FIGS. 1 to 3 thereof, there is illustrated a fence assembly according to the invention for surrounding, for example, a compound. The fence assembly is indicated generally by the reference numeral 1 and comprises a plurality of interlocking panels 2 arranged in a zig-zag relationship. The panels 2 are of semi-rigid net-like material having a plurality of closed meshes 3; and in this case the panels are of expanded metal mesh material. Each panel 2 is bent at 4 intermediate its side edges 5 to form an included angle of approximately 90°. This provides considerable rigidity to the fence assembly and in general eliminates the need for support stanchions or fence posts.

The panels 2 are joined along their side edges 5 by means of portions 6 of some of the meshes 3 of one panel projecting through meshes 3 of an adjacent panel. The interlocking meshes are intertwined with each other at 7 to retain the panels interlocked. This can clearly be seen in FIG. 2.

The intertwining of the portions at 7 is achieved by inserting the blade of a tool 8 between the interlocking meshes as illustrated in FIG. 3. The tool 8 is then moved through an arc of substantially 270° in the direction of the arrow A until the tool takes up the position shown by the broken lines in FIG. 3. Needless to say, other suitable methods could be used to intertwine the meshes 3.

In this particular embodiment of the invention each pair of interlocking meshes is intertwined in the manner just described, although, needless to say, any desired number of pairs of meshes could be intertwined, for example, if desired, each alternate pair of interlocking meshes may be intertwined.

In use, in order to enhance the strength and rigidity of of the fence assembly, the lower portion of the panels 2 are buried in the ground.

To erect a fence, a trench is dug in the ground to any desired depth, a particularly suitable depth is approximately 450 mm. However, this largely depends on the type of soil. The panels 2 having been already bent at 4 are placed in the trench. Adjacent side edges 5 of adjacent panels 2 are offered up to each other and portions 6 of the meshes of one panel are projected through the meshes 3 of an adjacent panel. The tool 8 is used to intertwine the desired number of interlocking pairs of meshes 3.

The trench is then filled in with soil. It has been found that ideally the trench should be filled in with a relatively fine material rather than using, for example, large aggregates or concrete: clay is a better medium for anchoring the fence assembly than, for example, concrete. It has been found that the fence assembly tends to restore itself to its original shape after an impact when it is buried in clay, while where more rigid anchorage is used permanent deformation may result on impact.

Figure 4:
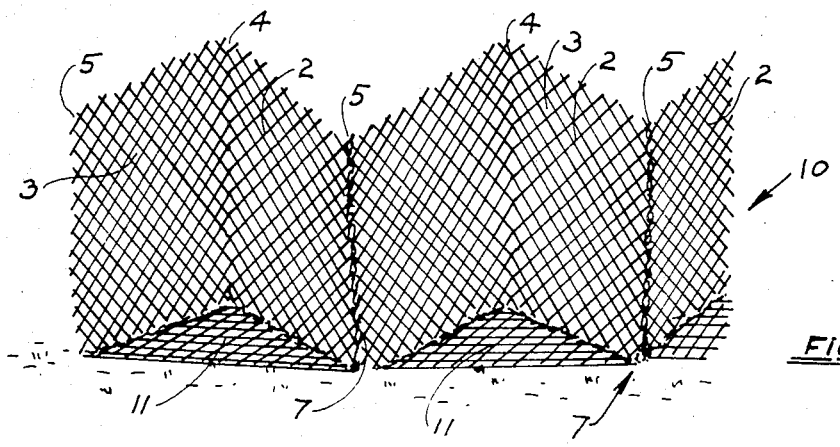
FIG. 4 is a perspective view of portion of a fence assembly according to another embodiment of the invention.
Figure 5:
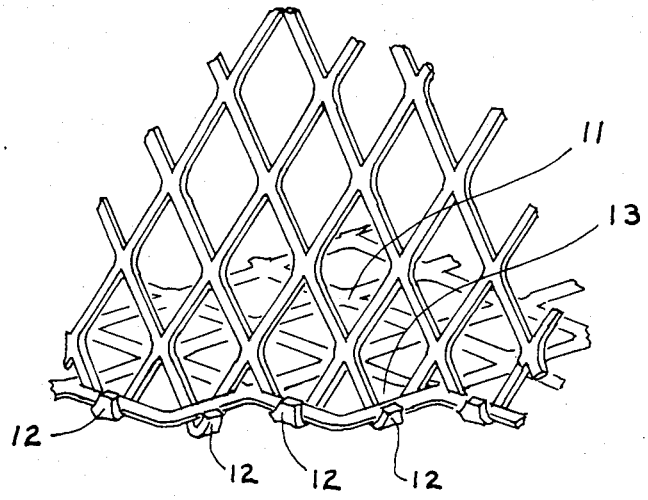
FIG. 5 is a perspective view of portion of an anchor means of the fence assembly of FIG. 4.
Figure 6:
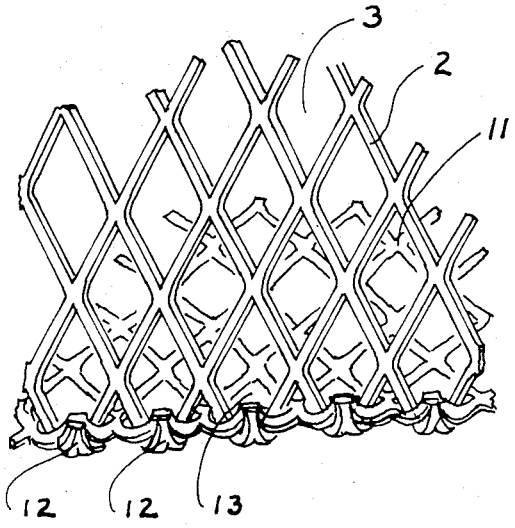
FIG. 6 is a perspective view also of portion of the anchor means of the fence assembly of FIG. 4.

Referring now to FIGS. 4 to 6 there is illustrated a fence assembly 10 according to another embodiment of the invention. This fence assembly is substantially similar to that described with reference to FIGS. 1 to 3 and like components are identified by the same reference numeral. In this case an anchor means formed by a base member 11 is provided to further secure the fence assembly in the ground. The base member 11 is of expanded metal mesh material and is mounted between the halves of each bent panel 2. Each base member 11 is joined to the lower portion of a panel 2 in substantially similar fashion as that used for joining the panels.

Depending on the orientation of the base member 11 to the panels 2 (see FIGS. 5 and 6), one or two portions 12 of meshes 3 of the panel 2 project through meshes 13 of the base member 11. The projecting portions 12 are then bent upwardly through an angle of approximately 180° thereby retaining the meshes 3 and 13 securely interlocked.

It will be appreciated that while the base member 11 has been described as extending between the halves of a bent panel 2, the base member 11 could extend between halves of adjacent panels 2.

The erection of this fence assembly is substantially similar to that just described; a trench is dug and the lower portion of the fence assembly is buried. It will also be appreciated that in certain cases the base member could be secured to the surface of the ground by for example, masonry bolts (not shown) or the like.

Figure 7:
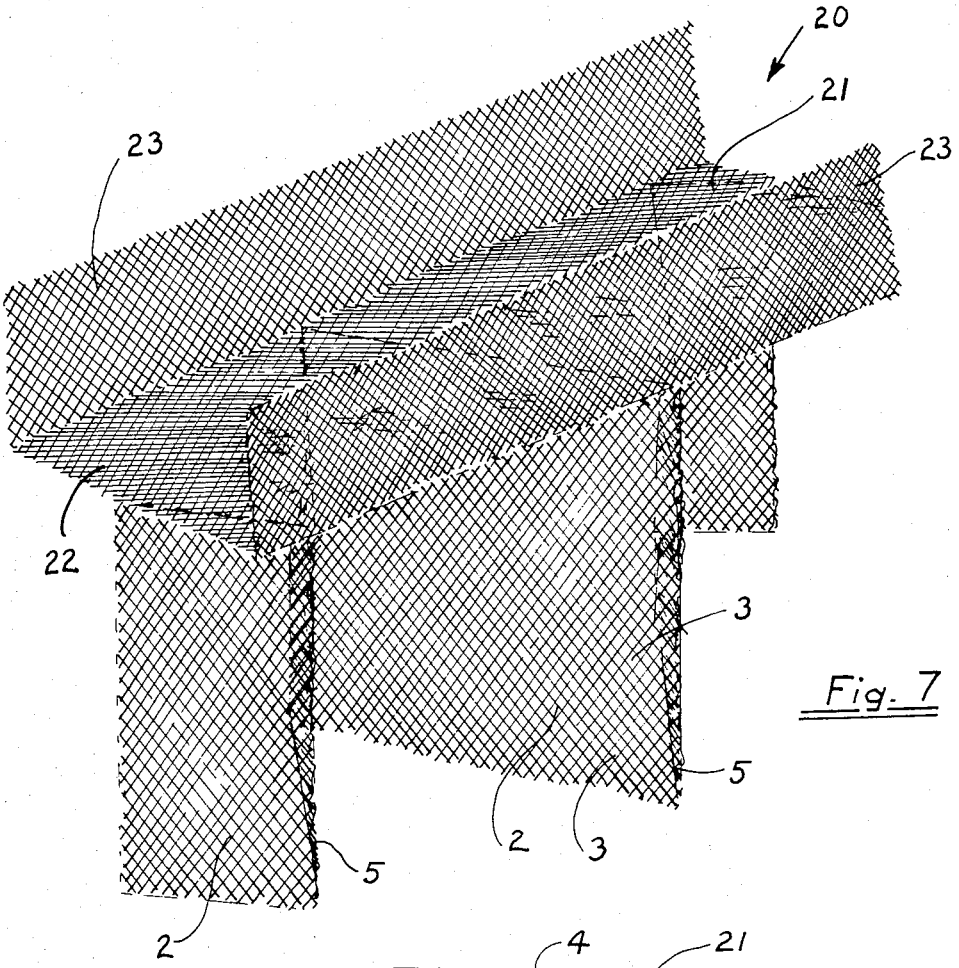
FIG. 7 is a perspective view of a fence assembly according to another embodiment of the invention.
Figure 8:
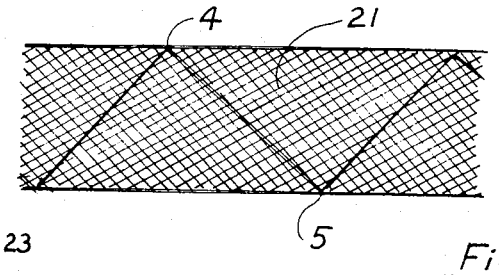
FIG. 8 is a plan view of the fence assembly of FIG. 7.
Figure 9:
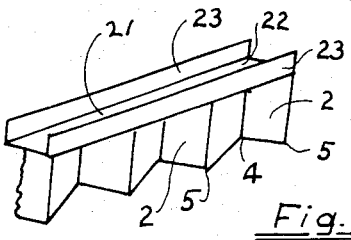
FIG. 9 is a diagrammatic perspective view of the fence assembly of FIG. 7.

Referring now to FIGS. 7 to 9 there is illustrated a fence assembly 20 according to a further embodiment of the invention. This fence assembly is substantially similar to those already described and similar components are identified by the same reference numerals. This fence assembly 20 includes a cat-walk 21 comprising a base 22 with sides 23, all manufactured from expanded metal mesh bent to the desired shape. The base 22 of the cat-walk 21 is joined to the panels 2 in similar fashion as the panels 2 are joined to the base member 11 described with reference to FIGS. 5 and 6. Portions of the meshes at the top of the panels project through meshes of the base of the cat-walk, and the projecting meshes are bent over through an angle of approximately 180° to interlock with the meshes of the base 22. It will be appreciated that the provision of the cat-walk, in addition to its normal function, ensures added rigidity is imparted to the fence assembly.

Figure 10:
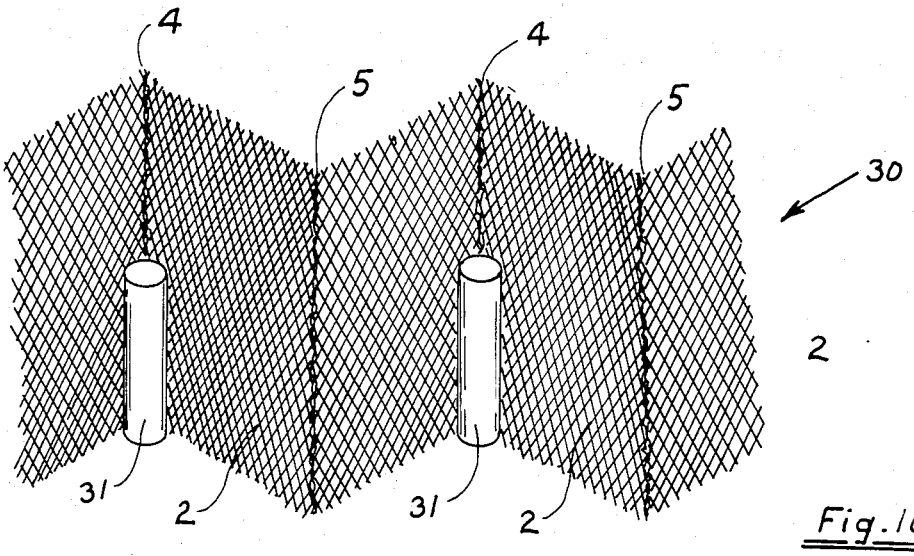
FIG. 10 is a perspective view of a fence assembly according to another embodiment of the invention.
Figure 11:
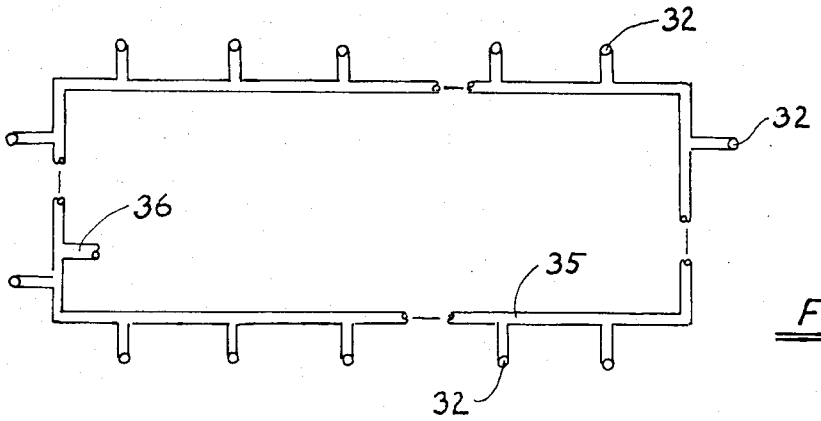
FIG. 11 is a plan view of portion of the fence assembly of FIG. 10.
Figure 12:
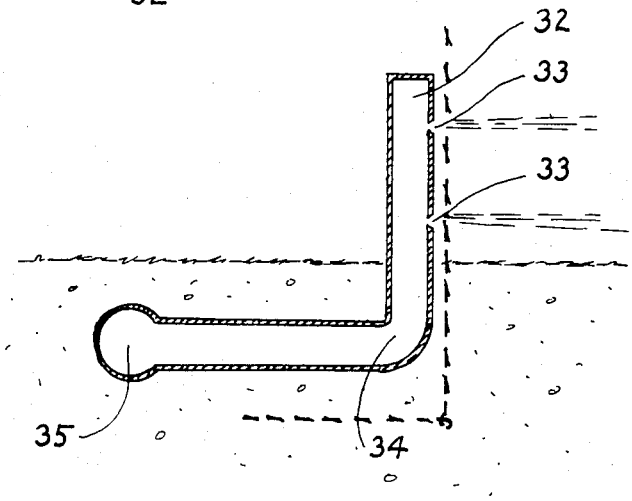
FIG. 12 is a sectional elevational view of portion of the fence assembly of FIG. 10.

FIGS. 10 to 12 illustrate a fence assembly 30 according to a still further embodiment of the invention. Again, this fence assembly is substantially similar to those described and similar components are identified by the same reference numeral. In this case upright support members indicated generally by the reference numeral 31 are mounted within the perimeter of the fence assembly. Each support member 31 is formed by a pipe 32 with water jets 33. The pipe 32 is bent at 34 and connected to a high pressure water ring main 35. An inlet 36 is connected to the ring main 35 to deliver high pressure water, which is in turn delivered through the jets 33, and in turn through meshes 3 of the fence assembly for crowd control, and other such uses. If desired the fence assembly may be secured to the upright support members by brackets or other suitable means.

In the event of a riot, the upright support members 31 will generally prevent the fence assembly being pushed inwardly, while at the same time if necessary, water may be pumped through the ring main 35 for delivery through the jets 33.

Figure 13:
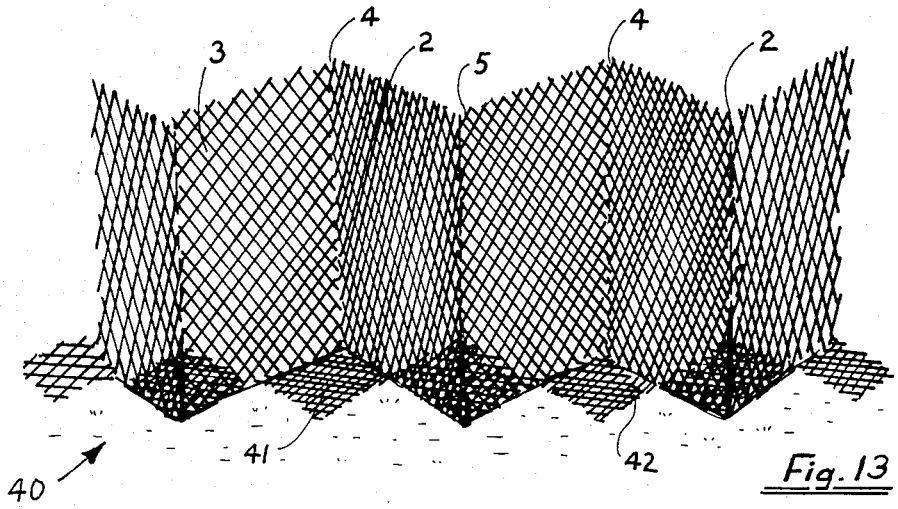
FIG. 13 is a perspective view of a fence assembly according to a further embodiment of the invention.
Figure 14:
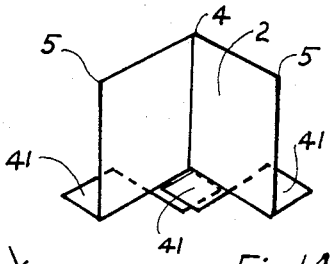
FIG. 14 is a diagrammatic perspective view of portion of the fence assembly of FIG. 13.
Figure 15:
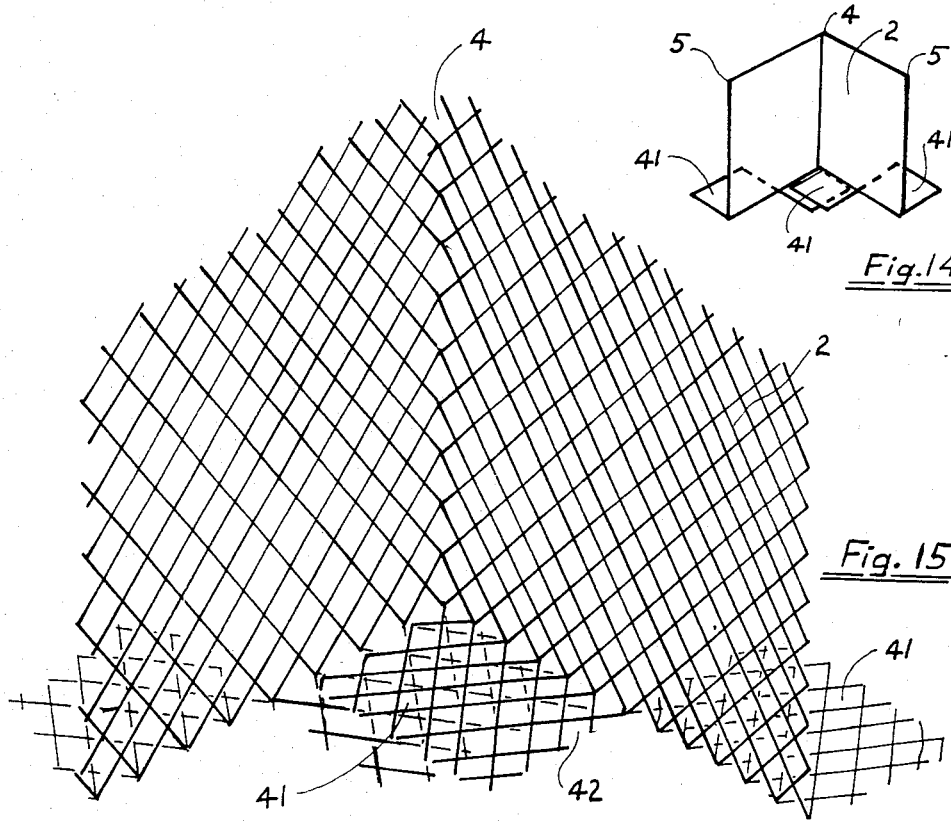
FIG. 15 is a perspective view of a detail of the fence assembly of FIG. 13.

FIGS. 13 to 15 illustrate a fence assembly 40 according to a still further embodiment of the invention. Again, this assembly is substantially similar to those already described and like components are identified by the same reference numerals. In this embodiment of the invention, the anchor means is provided by base members 41 formed by portions of the panels 2. The lower portions of the panels 2 are cut at 42 and the portions on either side of the cut 42 are bent sidewardly on either side of the panel to form the base members 41. The base members 41 are bent in such a way that the overall ground area occupied by the fence assembly is not greater than the ground area defined by the panels 2. This can most clearly be seen in FIG. 13. In use, the fence assembly with the base members 41 is buried in a trench although, needless to say, it could be secured to the surface of the ground by means of bolts or suitable brackets through the base members 41.

Figure 16:
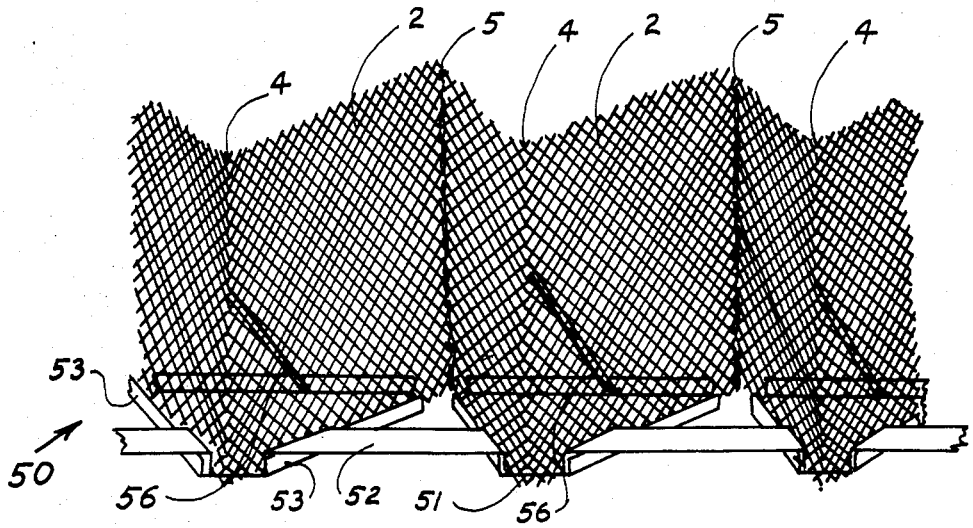
FIG. 16 is a perspective view of a fence assembly according to a still further embodiment of the invention.
Figure 17:
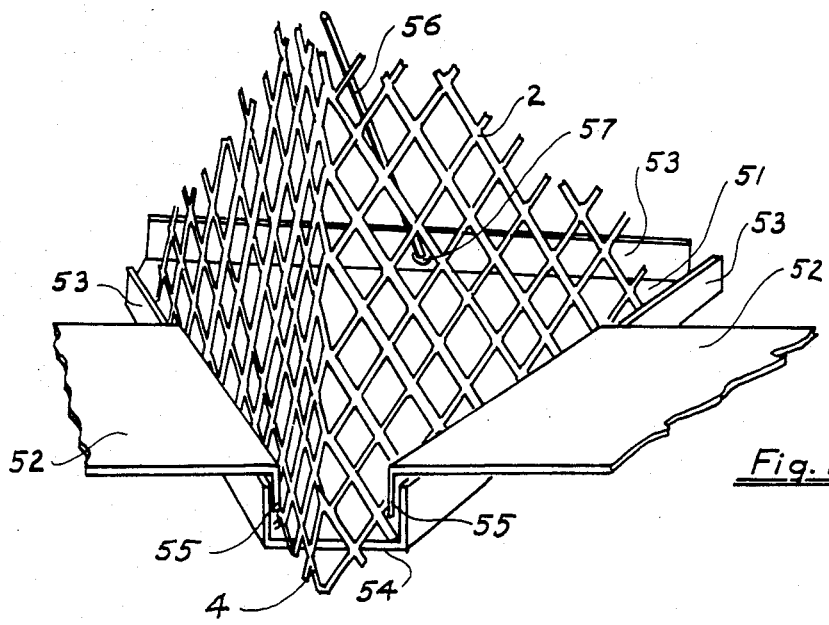
FIG. 17 is a perspective view of a detail of the fence assembly of FIG. 16.

Referring now to FIGS. 16 and 17 a fence assembly according to a still further embodiment of the invention is illustrated. This assembly 50 is again substantially similar to those already described and similar reference numerals identify the same components. In this case, anchor means is provided by base members 51 and 52. The base members 51 are of substantially triangular shape having side members 53 which are relieved at the apices of the triangle. Each base member 51 is secured to the lower end of each panel so that the bend 4 in the panel coincides with the apex 54 of the base member 51. The side members 53 are then spot welded at appropriate points to the lower portion of the panel 2. The base members 52 extend between the base members 51 of adjacent panels 2. Side members 55 on each base member 52 engage between the side members 53 and the panels 2, to secure the base members 52 in position. This can most clearly be seen in FIG. 20. To further strengthen the fence assembly, struts 56 extend from a side member 53 to engage each panel 2 at its bend 4 at a distance above the ground. A hole 57 is provided in the side member 53 to accommodate the strut 56.

Figure 18:
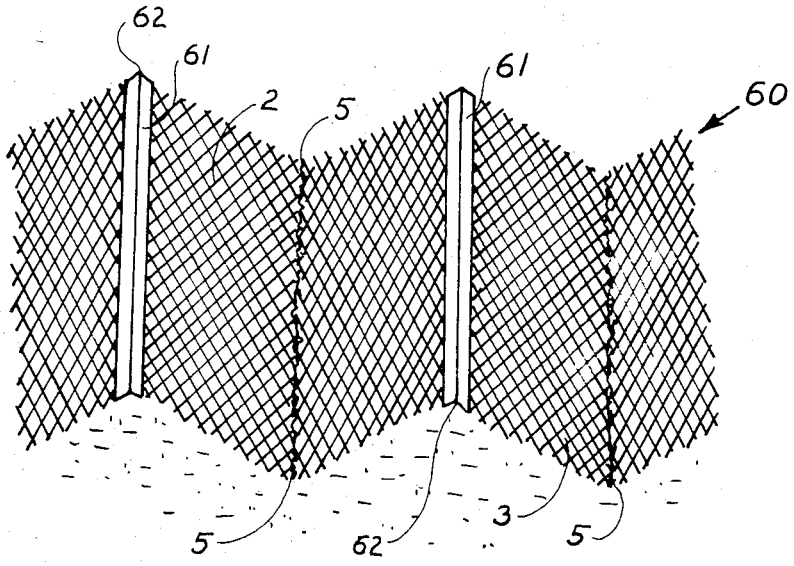
FIG. 18 is a perspective view of a fence assembly according to a still further embodiment of the invention.

Referring now to FIG. 18 a fence assembly 60 according to a still further embodiment of the invention is illustrated. This fence assembly 60 is substantially similar to those described and similar components are identified by the same reference numerals. In this embodiment of the invention each panel 2 is again of expanded metal mesh material, however, portions 61 of the panel is solid, in other words, each panel at the portion 61 is left unexpanded. This provides a solid strengthening portion for the panel, and in this embodiment of the invention each panel 2 is bent along the strengthening portion 61 at 62. This, accordingly, forms the strengthening portion 61 into a member of angle section, which considerably enhances the strength and rigidity of the fence assembly.

Figure 19:
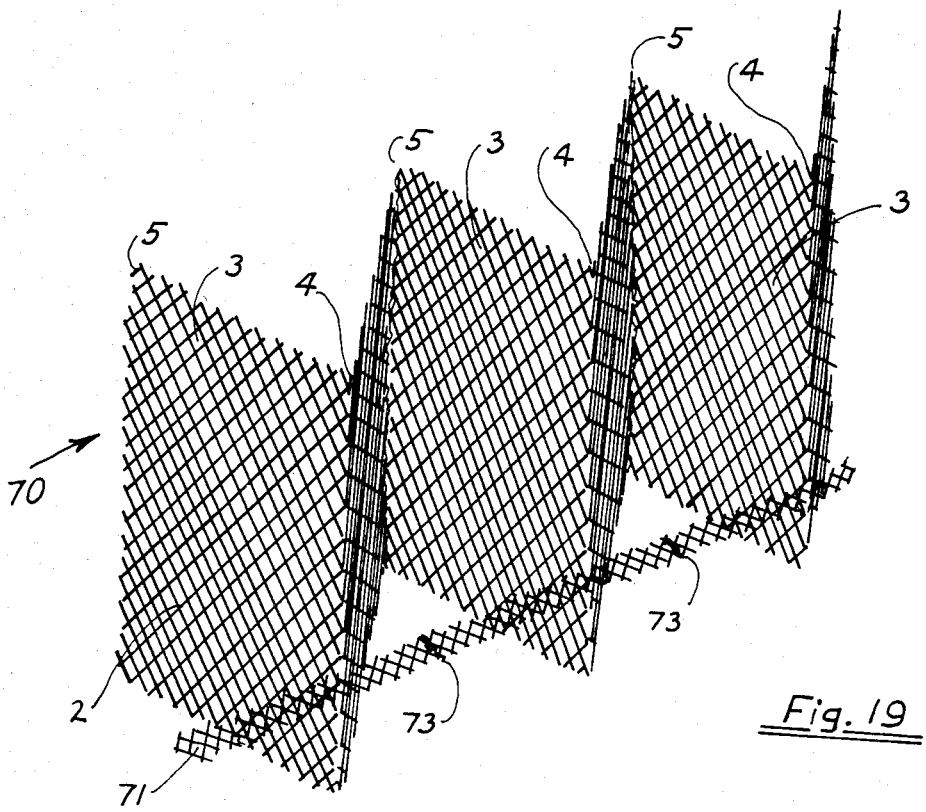
FIG. 19 is a perspective view of a fence assembly according to a still further embodiment of the invention.

Referring now to FIG. 19 a fence assembly 70 according to a still further embodiment of the invention is provided. This fence assembly is again substantially similar to those just described and similar components are identified by the same reference numeral. In this case a base member is formed by an anchor strip 71 of expanded metal mesh attached to each panel 2. Each strip 71 extends between the halves of a bent panel 2 and extends outwardly on either side. The strips 71 are joined to the panels 2 in similar fashion as the base members 11 are joined to the panel of the fence assembly described in FIGS. 4 to 6. Anchor strips 71 of adjacent panels are joined at 73 by means of the meshes of one strip projecting through the meshes of an adjacent strip and then being bent to interlock as already described. The fence assembly may be buried in a trench in the ground or alternatively, may be mounted on the surface of the ground by means of brackets, bolts or the like secured to the anchor strip 71.

It will be appreciated that while in this case the anchor means has been described as a strip of expanded metal mesh attached to each panel 2, it will be appreciated that a single continuous strip of expanded metal mesh, or any other suitable material could be laid beneath the fence assembly which could then be secured to it.

It will be appreciated that although the panels of the fence assembly have been described as being manufactured from expanded metal mesh material, other suitable semi-rigid net-like materials could be used. Indeed, it is envisaged that in certain cases a plastics material could be used. It will also be appreciated that although the panels have been described as being bent intermediate their ends, this is not necessary: the fence assembly could be provided by a plurality of flat panels which would form the zig-zag arrangement. Indeed, it will be appreciated that the panels could be bent at a number of positions intermediate their ends, for example, the panels could be bent in two, three or more places; in which case, each panel would itself form the zig-zag arrangement. In this case, it is envisaged that solid strengthening portions may be provided in the panel at each position where it is to be bent.

It will be appreciated that while in all the embodiments of the invention described, the fence assembly is described as being buried in the ground, this is not necessary. In certain cases, the fence assembly may be secured to the surface of the ground by means of anchor bolts or brackets. Additionally, anchor means are not necessary, since right angle brackets or other suitable means could be attached to the lower portion of the panels for securing to the ground. Indeed, it will also be appreciated that while the fence assembly has been described as being buried by soil, it could be set in concrete, hard core or the like.

It will of course be understood by those skilled in the art that although the interlocking meshes of adjacent panels have been described as being intertwined with each other, this is not necessary. It will be appreciated that all that is necessary to retain the meshes interlocked is for one of the meshes, for example, the projecting portion, to be bent through an angle, preferably, an angle of at least 90°.

It is envisaged that in certain cases the panels of the fence assembly may not be joined along their side edges. For example, in certain cases it is envisaged that the side edge of one panel may engage the adjacent panel at a position spaced apart from the side edge of that panel. It will also be appreciated that while the panels have been described as being bent at an angle of approximately 90°, this is not necessary. They could be bent at any suitable angle. Neither is it necessary for the panels to be disposed to each other at an angle of 90°, they could be disposed at any desired angle.

It will further be appreciated that although the solid strengthening portion has been described as being formed at the position at the bend in each panel, this is not necessary, the strengthening portion could be provided at any suitable area of the panel.

It is envisaged that instead of providing a cat-walk, with side walls, a simple capping sheet may be provided and the capping sheet used to mount, for example, anti-vandal devices or the like thereon.

It will also be appreciated that in certain cases the cat-walk or base member instead of being joined to the fencing panels by interlocking, could be joined by other suitable means, for example, spot-welding, screws, bolts or the like.

I claim:

1. A fence assembly comprising:

a plurality of interlocking panels of semi-rigid net-like material arranged in zig-zag relationship, the panels being bent intermediate their side edges, the bend being well in from the side edges, each panel having a plurality of closed meshes and being joined to another panel by portion of at least some of the closed meshes of the panel adjacent a side edge thereof, projecting through closed meshes of the other panel, at least some of the meshes being bent to interlock with the meshes of the other panel.

2. A fence assembly as claimed in claim 1 in which the projecting meshes are bent through an angle of at least 90°.

3. A fence assembly as claimed in claim 1 in which the panels are joined adjacent their side edges and interlocking meshes are intertwined with each other.

4. A fence assembly as claimed in claim 1 in which the panels are bent intermediate their side edges to form an included angle of approximately 90°.

5. A fence assembly as claimed in claim 4 in which a solid strengthening portion extends the length of each panel intermediate the side edge, the panel being bent along the solid strengthening portion to form a member of angle section in each panel.

6. A fence assembly as claimed in claim 5 in which each panel is of expanded metal mesh, the solid strengthening portion being formed by leaving portion of each panel unexpanded.

7. A fence assembly as claimed in claim 1 in which anchor means are provided by a base member projecting sidewardly from some or all of the panels.

8. A fence assembly as claimed in claim 7 in which the base member extends between each half of a bent panel.

9. A fence assembly as claimed in claim 7 in which the base member is of a semi-rigid net-like material and is joined to the panels by portions of at least some of the meshes of the panels projecting through meshes of the base member, the projecting meshes being bent to interlock with the meshes of the base member.

10. A fence assembly as claimed in claim 1 in which a cat-walk provided by a capping member of a semi-rigid net-like material is mounted on top of the fence panels, and is joined thereto by portions of some of the meshes of the panels projecting through meshes of the capping member, the projecting meshes being bent to interlock with the meshes of the capping member.

11. A fence assembly as claimed in claim 1 in which upright support members are provided in at least some of the included angles formed by the panels of the fence assembly, water jets outwardly directed of the fence assembly being mounted on the upright support members.

12. A fence assembly as claimed in claim 1 in which the semi-rigid net-like material is expanded metal mesh.

13. A fence assembly as claimed in claim 1 in which the lower portion of the panels is buried in the ground.

14. A panel for use in the fence assembly of claim 1.

* * * * *